US010882049B2

(12) United States Patent
Rossiter et al.

(10) Patent No.: US 10,882,049 B2
(45) Date of Patent: Jan. 5, 2021

(54) TOOL FOR WORKING ABRASIVE MATERIALS

(71) Applicants: THYSSENKRUPP INDUSTRIAL SOLUTIONS AG, Essen (DE); thyssenkrupp AG, Essen (DE)

(72) Inventors: Eduardo Rossiter, Hamm (DE); Christian Neyer, Osnabrück (DE)

(73) Assignees: THYSSENKRUPP INDUSTRIAL SOLUTIONS AG, Essen (DE); THYSSENKRUPP AG, Essen (DE)

( * ) Notice: Subject to any disclaimer, the term of this patent is extended or adjusted under 35 U.S.C. 154(b) by 236 days.

(21) Appl. No.: 15/770,713

(22) PCT Filed: Oct. 21, 2016

(86) PCT No.: PCT/EP2016/075418

§ 371 (c)(1),
(2) Date: Apr. 24, 2018

(87) PCT Pub. No.: WO2017/080796

PCT Pub. Date: May 18, 2017

(65) Prior Publication Data

US 2018/0250681 A1 Sep. 6, 2018

(30) Foreign Application Priority Data

Nov. 9, 2015 (DE) ..... 10 2015 222 020

(51) Int. Cl.
*B02C 18/18* (2006.01)
*B02C 13/28* (2006.01)
*E02F 9/28* (2006.01)

(52) U.S. Cl.
CPC ..... *B02C 13/2804* (2013.01); *B02C 18/18* (2013.01); *B02C 2210/02* (2013.01); *E02F 9/285* (2013.01)

(58) Field of Classification Search
CPC ..... B02C 13/28; B02C 13/2804; B02C 18/18; B02C 2013/2808; B02C 2013/2812; B02C 2013/2816
(Continued)

(56) References Cited

U.S. PATENT DOCUMENTS 276,200 A * 4/1883 Todd ..... B02B 3/08 99/526
1,787,526 A * 1/1931 Honstain ..... B22D 19/00 164/111
(Continued)

FOREIGN PATENT DOCUMENTS

CH 466351 A 12/1968
CN 201046414 Y 4/2008
(Continued)

OTHER PUBLICATIONS

English Translation of International Search Report issued in PCT/EP2016/075418, dated Jan. 4, 2017 (dated Jan. 16, 2017).

*Primary Examiner* — Shelley M Self
*Assistant Examiner* — Smith Oberto Bapthelus
(74) *Attorney, Agent, or Firm* — thyssenkrupp North America, LLC

(57) ABSTRACT

A tool for processing abrasive materials, in particular rocks, sand or ores, may include a main tool body and a hard metal plate positioned on the main tool body. A build-up weld may be applied to a surface of the hard metal plate and to the main tool body to bond the hard metal plate to the main tool body. Further, a method for producing or treating such a tool may involve positioning the hard metal plate on the main tool body and applying a build-up weld to the hard metal plate and the main tool body such that the hard metal plate is attached to the main tool body.

20 Claims, 3 Drawing Sheets

(58) Field of Classification Search
USPC ..... 241/191, 195, 197
See application file for complete search history.

(56) References Cited

U.S. PATENT DOCUMENTS 1,821,912 A * 9/1931 Pfeiffer ..... B02C 13/28 241/86.2
2,253,087 A * 8/1941 Neal ..... B02C 13/28 241/189.1
2,635,817 A * 4/1953 Long ..... B02C 13/2804 241/197
3,045,934 A * 7/1962 Eilers ..... B02C 13/28 241/197
3,089,353 A * 5/1963 Craven ..... B23K 35/304 76/108.1
3,425,117 A * 2/1969 Hill ..... E02F 9/285 228/170
3,561,686 A * 2/1971 Hedrick ..... B02C 13/28 241/197
3,838,826 A * 10/1974 Wallace ..... B02C 13/2804 241/197
3,880,369 A * 4/1975 Kunstovny ..... B02C 13/2804 241/300
4,352,774 A * 10/1982 Hornberger ..... B02C 13/28 241/197
4,871,119 A * 10/1989 Murata ..... B02C 13/2804 241/189.1
5,114,082 A * 5/1992 Brundiek ..... B02C 4/305 241/121
5,778,572 A * 7/1998 Lukavich ..... E02F 9/285 172/701.3
6,085,963 A 7/2000 Abela
6,454,195 B1 * 9/2002 Amano ..... B02C 13/2804 144/241
7,137,583 B2 * 11/2006 Kammerer ..... B02C 13/28 241/294
10,207,274 B1 * 2/2019 Young ..... B23K 9/0026
2007/0128986 A1 * 6/2007 Imai ..... B24B 53/053 451/11
2010/0166512 A1 * 7/2010 Tanibuchi ..... C23C 16/34 407/119
2011/0017519 A1 * 1/2011 Bertagnolli ..... E21B 10/567 175/428
2011/0248550 A1 * 10/2011 Knotts ..... B02C 4/08 299/105
2012/0037431 A1 * 2/2012 DiGiovanni ..... E21B 10/5676 175/428
2012/0258273 A1 * 10/2012 Churchill ..... E02F 9/285 428/68
2013/0168477 A1 * 7/2013 Doppstadt ..... B02C 13/28 241/197
2013/0209184 A1 * 8/2013 Barry ..... B23C 5/10 407/54
2013/0233955 A1 * 9/2013 Morrow ..... B02C 13/28 241/189.1
2013/0248630 A1 9/2013 Martens
2013/0284841 A1 * 10/2013 Pellman ..... B02C 18/18 241/246
2014/0157682 A1 * 6/2014 Petree ..... B22F 7/06 51/309
2014/0284114 A1 * 9/2014 Mirchandani ..... C22C 1/00 175/374
2015/0063904 A1 * 3/2015 Yacobucci ..... F16B 21/08 403/327
2015/0259988 A1 * 9/2015 Chen ..... E21B 10/5673 175/430
2018/0250681 A1 * 9/2018 Rossiter ..... B02C 13/2804
2019/0168230 A1 * 6/2019 Young ..... B02C 13/04
2019/0226510 A1 * 7/2019 Cott ..... B32B 15/04

FOREIGN PATENT DOCUMENTS

CN 202417494 U 9/2012
CN 202570312 U 12/2012
CN 102962114 A 3/2013
DE 2 422 761 A 11/1975
DE 4210892 * 9/1993
DE 4210910 * 11/1993
DE 102005027729 A 12/2006
DE 202010010294 U 12/2011
EP 2891522 A 7/2015
EP 2 940 169 A 11/2015
GB 1443531 * 7/1976
GB 1443531 A 7/1976
JP H-0528466 A 2/1993
JP 2001-347175 A 12/2001
SU 237720 A1 12/1969
SU 732466 A1 5/1980
SU 1263837 A1 10/1986
SU 1742472 A1 6/1992

* cited by examiner

TOOL FOR WORKING ABRASIVE MATERIALS

CROSS REFERENCE TO RELATED APPLICATIONS

This application is a U.S. National Stage Entry of International Patent Application Serial Number PCT/EP2016/075418, filed Oct. 21, 2016, which claims priority to German Patent Application No. DE 10 2015 222 020.6, filed Nov. 9, 2015, the entire contents of both of which are incorporated herein by reference.

FIELD

The present disclosure generally relates to tools for processing abrasive materials, including rocks, sand, oil sand, and/or ores.

BACKGROUND

Tools for processing abrasive materials are used in known apparatuses for processing rocks, sand, oil sand or ores, such as for example crushers, such as roll crushers or sizers, or excavators. The tools, such as for example crusher teeth or excavator teeth, are exposed to high levels of wear and have therefore to be replaced regularly. Wear to the tools differs widely in particular in the case of tools mounted at different positions on the processing apparatus. For example, crushing tools arranged within the flow of material through the comminution apparatus wear significantly faster than crushing tools at the edge of the material flow. As a result of this irregular wear, it is known for example just to replace or repair individual crushing tools.

When repairing crushing tools, the original geometry of the crushing tool from before the onset of wear is re-established. It is known for example from EP 2891522 A1 to apply a build-up weld to the worn area, in order on the one hand to re-establish the geometry of the crushing tool and on the other hand to apply an additional antiwear layer to the crushing tool. However, due to the low carbide concentration of at most around 61% in the filler material used for the build-up welds, such build-up welds have low hardness.

Thus a need exists for a tool with high wear resistance and a method for producing or treating such a tool.

DETAILED DESCRIPTION

Figure 2:
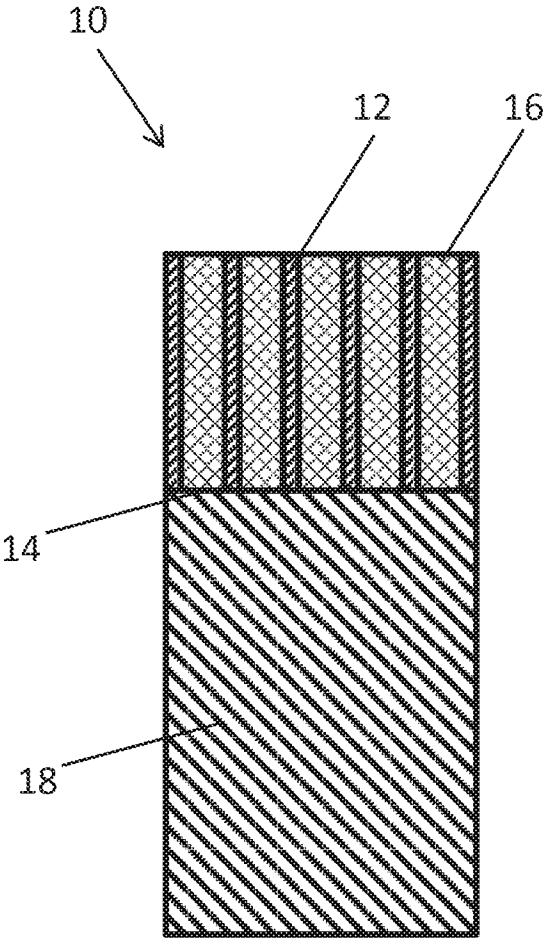
FIG. 2 is a schematic front view of the example tool of FIG. 1 but with a plurality of hard metal plates.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by 'at least one' or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

According to a first aspect, a tool for processing abrasive materials, in particular rocks, sand or ores, comprises a main tool body and at least one hard metal plate arranged on the main tool body, wherein a build-up weld is applied to the surface of the hard metal plate and to the main tool body, by which weld the hard metal plate is bonded to the main tool body.

Abrasive materials should be understood to mean in particular minerals, such as for example rock, ores, coal, sand and oil sand.

The tool in particular comprises a crushing tool for comminuting rocks, oil sand, ores or other wear-inducing materials, such as for example a crusher tooth or a beating arm of a roll crusher, a crushing hammer of a hammer crusher or impact plates or prismatic elements of a crushing jaw of modular construction. The tool further comprises an excavator tooth, for example. The tool preferably comprises a locally delimitable wear region, which is arranged on the side faces of the crushing tool pointing substantially in the force direction, in particular in the crushing direction, and is worn during operation of the tool. The worn region of the crushing tool is for example an indentation on the surface of the tool.

The main tool body comprises at least the region of the tool which is exposed to wear during the processing of abrasive materials. The main tool body is for example made from a steel.

A hard metal plate should be understood substantially to mean a plate of a hard metal, such as for example sintered metal carbides, consisting in particular of 90-94% tungsten carbide and 6-10% cobalt. A hard metal plate arranged on the main tool body offers a high level of wear protection for the surface of the main tool body. In particular, the wear protection merely encompasses the region of the main tool body at which the greatest wear occurs during tool operation.

Build-up welding should be understood to mean a thermal coating method for surface treatment. A build-up weld provides a wear- and corrosion-resistant layer on a base material. By means of a heat source, for example a laser beam, the surface of the region to be provided with the build-up weld is heated and a filler material, in powder form or as a wire, is supplied and likewise heated by the heat source and applied to the surface of the main tool body. The filler material melts virtually completely. The filler material for example comprises a hard metal, such as for example materials with a high nickel content, tungsten carbide or titanium carbide. Build-up welding for example comprises laser build-up welding or plasma transferred arc welding (PTA). The build-up weld is applied to the surface of the hard metal plate and to the surface of the main tool body. This enables reliable attachment of the hard metal plate to the main tool body, wherein this attachment withstands a heavy mechanical load, in particular a crushing force, acting on the tool. Unlike other means of attachment, such as for example brazing or welding of the hard metal plate to the surface of the main tool body, a build-up weld offers the advantage of high strength and the fact that it causes only a slight temperature increase in the hard metal and the material of the main tool body. The main tool body of the tool is formed for example from a quenched and tempered steel, wherein welding or brazing, in particular at high temperatures of above around 600° C., destroys the grain structure of the material of the tool, so reducing the hardness and strength of the material of the tool. A build-up weld offers the advantage of being bonded to the hard metal and the material of the main tool body by way of a metallurgical bond, such that the build-up weld is firmly bonded to the surface of the main tool body and to the hard metal plate and withstands heavy mechanical loads. The build-up weld is in particular applied to the hard metal plate and the main tool body with only slight mixing of the hard metal of the former and the material of the latter. Laser build-up welding or plasma transferred arc welding (PTA) in particular allow only slight mixing of the material of the main tool body and the hard metal.

Mixing is understood in particular to mean the ratio between the total mass of a component and the mass which is melted and bonded by the build-up welding process. Conventionally, during melting and subsequent solidification the grain structure of the material is changed, for example destroyed. With only slight mixing a major part of the grain structure is retained, such that the hardness and the strength of the material are not influenced at all or only very slightly. The low amount of mixing of the material of the crushing tool and of the hard metal plate during build-up welding therefore reduces the amount by which the mechanical properties of the hard metal plate and of the main tool body deteriorate. In particular, the hard metal plate is at least partly enveloped by the build-up weld.

According to a first embodiment, a plurality of hard metal plates are mounted on the main tool body which are each bonded to the main tool body by way of a build-up weld. The hard metal plates have different geometries, for example.

According to one further embodiment, the hard metal plates are arranged parallel to one another. A mutually parallel arrangement of the hard metal plates allows optimum absorption of forces acting on the tool, such as for example forces which arise during processing of rocks, ores or sand, such as crushing forces of a crushing apparatus.

According to one further embodiment, each hard metal plate is bonded to a respective adjacent hard metal plate by way of a build-up weld. The hard metal plates are in particular arranged with uniform mutual spacing on the main tool body, wherein the distance between two adjacent hard metal plates is preferably such that the build-up weld may be applied between the hard metal plates by means of laser build-up welding. In particular, the spacing of two hard metal plates has a value of 5-15 mm.

According to one further embodiment, the at least one hard metal plate is arranged in such a way on the main tool body that it extends in the direction in which a force acting on the tool acts. In particular, the parallel hard metal plates extend parallel to the crushing force of a crusher. During operation of the tool for processing abrasive materials, the build-up weld applied to the hard metal plates wears faster than the hard metal plates, since the build-up weld has lower wear resistance than the hard metal plate. During operation of the tool, therefore, a recess forms between the hard metal plates as wear of the build-up weld progresses, such that the hard metal plates act as cutting edges and simplify the processing, for example comminution, of the material to be processed. In addition, during operation of the tool, material becomes deposited between adjacent hard metal plates on which the build-up weld has worn, whereby further wear of the build-up weld is reduced.

According to one further embodiment, at least one hard metal plate is arranged in a groove formed in the surface of the tool body. This simplifies positioning of the at least one hard metal plate in the indentation and in particular application of the build-up weld to the hard metal plate.

According to one further embodiment, the main tool body comprises a plurality of grooves, wherein each hard metal plate is arranged in a respective groove.

According to one further embodiment, the main tool body comprises an indentation, in particular a worn region, wherein the at least one hard metal plate is arranged in the indentation. The indentation is for example a region in the surface of the main tool body which has been worn during tool operation.

According to one further embodiment, the at least one hard metal plate is formed and arranged in the indentation in such a way that it fills the cross section of the indentation. In particular, the at least one hard metal plate is arranged in such a way that it re-establishes the original geometry of the tool. The original geometry of the tool is understood to mean the geometry prior to the occurrence of wear to the surface of the main tool body during the processing of abrasive materials. In particular, the geometry of the hard metal plate corresponds to the cross section of the indentation, such that the hard metal plate arranged in the indentation substantially re-establishes the original cross-sectional geometry of the tool. The hard metal plates have different geometries, for example, and are arranged in the indentation, with the build-up welds applied to said hard metal plates, in such a way that they fill the indentation. Preferably, a plurality of grooves each for accommodating one hard metal plate are applied in the indentation.

The build-up weld preferably comprises a filler material of in particular tungsten carbide or titanium carbide. In particular, the filler material has a carbide concentration of around 50-61%, so achieving a high level of build-up weld wear resistance.

According to one further embodiment, the thickness of the build-up welds is greater than the thickness of the at least one hard metal plate. This enables economies of material to be made in terms of the relatively cost-intensive hard metal plates.

The invention further comprises a processing apparatus for processing abrasive materials, comprising at least one tool as described above. A processing apparatus for example comprises a crushing apparatus such as a roll crusher or a hammer crusher, wherein a plurality of tools are preferably arranged around the circumference of a crushing roll of the roll crusher.

The invention further comprises a method for producing or treating a tool for processing abrasive materials, in particular rocks, sand or ores, wherein the tool comprises a main tool body, wherein the method comprises the steps of:

arranging at least one hard metal plate on the main tool body and applying a build-up weld to the hard metal plate and the main tool body, such that the at least one hard metal plate is attached to the main tool body.

The embodiments and advantages described with reference to the tool also apply mutatis mutandis with regard to the method for producing or treating a tool. A tool as previously described is produced by the method for producing or treating a tool. In particular, the build-up weld is applied by means of laser welding or plasma transferred arc welding (PTA).

According to one embodiment, a plurality of hard metal plates are arranged parallel to one another on the main tool body. According to one further embodiment, each hard metal plate is bonded at least to an adjacent hard metal plate and the main tool body by a build-up weld.

Prior to arranging the at least one hard metal plate on the main tool body, the main tool body is machined according to one further embodiment. This results in a uniform, simple main tool body geometry, whereby the configuration of the hard metal plates for arrangement on the main tool body is simplified. For example, the main tool body is milled out.

According to one further embodiment, the hard metal plates are arranged in such a way on the main tool body that they extend substantially in the direction in which a force acting on the tool acts. In particular, the plane of the at least one hard metal plate extends in the direction in which the force acts, in particular a crushing force of a crushing apparatus.

According to one further embodiment, prior to the step of arranging the at least one hard metal plate on the main tool body, at least one groove is introduced into the surface of the main tool body, wherein the at least one hard metal plate is arranged in a groove.

This simplifies positioning of the hard metal plate on the main tool body, wherein the step of applying the build-up weld to the at least one hard metal plate is also significantly simplified.

According to one further embodiment, prior to the step of arranging the at least one hard metal plate on the main tool body a plurality of parallel grooves are introduced into the surface of the main tool body, wherein in each case one hard metal plate is arranged in each groove.

According to one further embodiment, the main tool body comprises an indentation, in particular a worn region, wherein the at least one hard metal plate is arranged in the indentation. In particular, the grooves are formed in the indentation of the main tool body.

Figure 1:
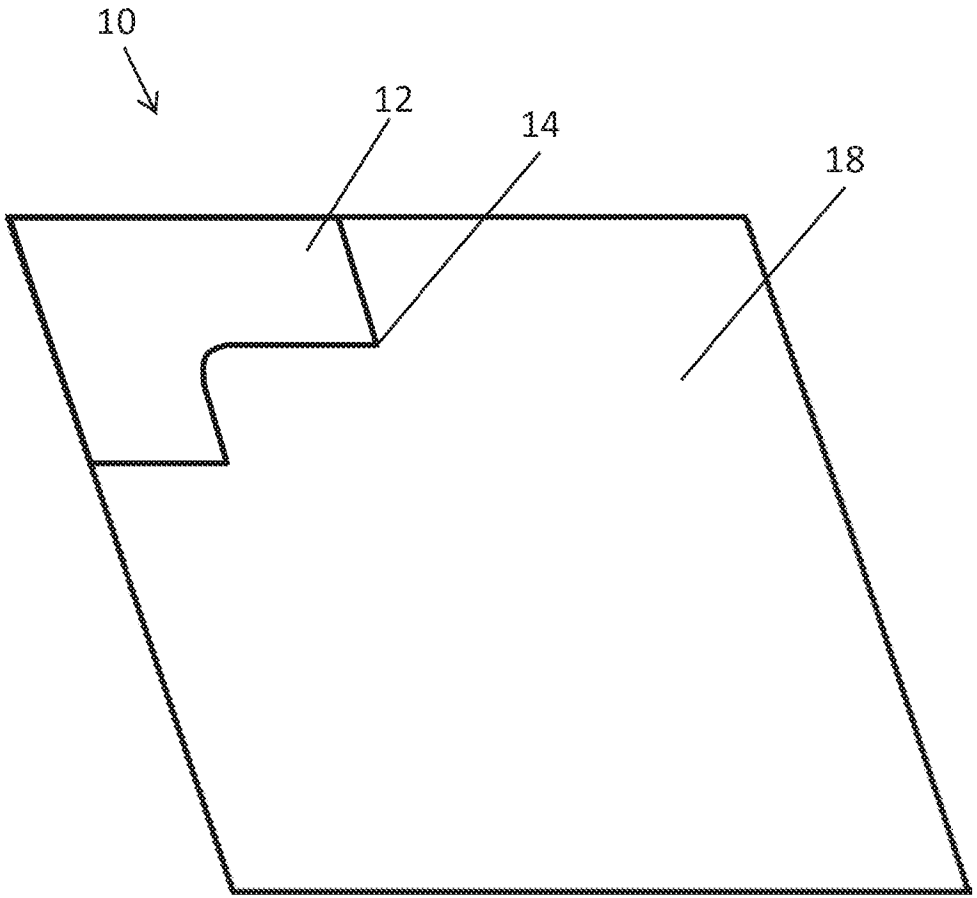
FIG. 1 is a schematic side view of an example tool with a hard metal plate.

FIG. 1 shows a tool 10 of an apparatus, not shown, for processing abrasive materials, such as for example rock, sand or ore. The schematically depicted tool 10 in particular comprises a crushing tooth for mounting on a crushing roll or an excavator bucket. By way of example, the tool comprises a main body 18, which in cross section has substantially the shape of a parallelogram, wherein the side faces of the tool 10 are inclined in the processing direction, in particular in the crushing direction of a crushing tool. The processing direction is in particular the direction in which the tool 10 moves during operation of the crushing apparatus for processing the material. The side face of the tool 10 shown on the left in FIG. 1 points in the processing direction during operation of the processing apparatus. The tool 10 is for example mounted on a roll of a roll crusher, wherein, during operation of the tool 10, the side face inclined substantially in the manner of a tooth and shown on the left in FIG. 1 and the upper face of the tool 10 are exposed to the greatest wear. The tool 10 may additionally comprise further tools in particular with a locally delimitable wear surface, such as a crushing tooth of any tooth shape or a hammer head of a hammer crusher.

The tool 10 comprises a main tool body 18 with an indentation 14, which for example comprises a region on the surface of the tool main tool body 18 which has suffered wear during operation of the processing apparatus. The indentation 14 extends for example from the side face pointing in the processing direction to the upper face of the tool 10.

A hard metal plate 12 is arranged in the indentation 14. The hard metal plate 12 substantially exhibits the shape of the cross section of the indentation 14 and is arranged in such a way in the indentation 14 that it fills the cross section of the indentation. In the case of a worn tool 10, the hard metal plate 12 arranged in the indentation 14 re-establishes the original cross section of the tool from the prior formation of the wear-related indentation 14 in the surface. The hard metal plate 12 is bonded to the main body 18 of the tool 10 by way of a build-up weld 16.

FIG. 2 shows a cross section of a front view of a tool 10 which corresponds to the tool of FIG. 1. The indentation 14 extends for example over the entire width of the side face pointing in the processing direction. A plurality of hard metal plates 12 are arranged in parallel and spaced uniformly relatively to one another in the indentation 14. The hard metal plates all exhibit substantially the same shape and are arranged in such a way in the indentation 14 that they extend substantially in the processing direction. Build-up welds 16 are arranged in each case between adjacent hard metal plates 12, bonding adjacent hard metal plates 12 to one another and the hard metal plates 12 to the main tool body 18 of the tool 10. The build-up welds 16 between the hard metal plates 12 extend over the entire height of the hard metal plates 12. The hard metal plates 12 and the build-up welds 16 are arranged in such a way in the indentation 14 of the main tool body 18 that, in the case of a worn main tool body 18, the original shape of the main tool body 18 from prior to formation of the wear-related indentation 14 is re-established.

The hard metal in particular comprises sintered metal carbides, with preferably 90-94% tungsten carbide embedded in 6-10% cobalt, in particular a cobalt matrix. The build-up welds for example comprise a filler material of hard metal, in particular tungsten carbides or titanium carbides. The build-up welds are preferably bonded to the hard metal of the hard metal plates by way of a metallurgical bond. For example, the build-up weld is applied to the hard metal plates and the main tool body 18 of the tool 10 by laser welding. In particular, the build-up weld is applied in such a way to the hard metal plate that only slight mixing is caused between the hard metal and the build-up weld.

The spacing of the hard metal plates 12 is configured in such a way that it is possible to apply a build-up weld 16 between two adjacent hard metal plates 12, for example by means of laser welding.

Figure 3:
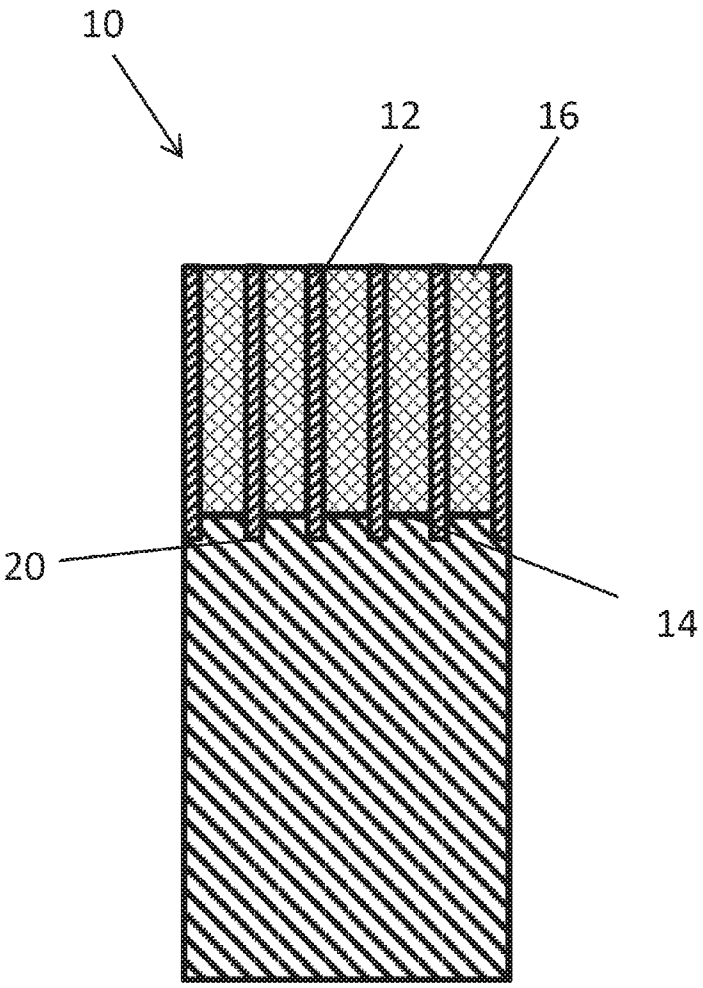
FIG. 3 is a schematic front view of another example tool with a plurality of hard metal plates.

FIG. 3 shows a tool 10 corresponding substantially to the tool 10 of FIG. 2, wherein, in contrast to the tool of FIG. 2, a plurality of grooves 20 are applied in the indentation 14. The grooves 20 extend substantially parallel to one another and exhibit a width which corresponds to the width of the hard metal plates. The grooves 20 form a holder for the hard metal plates 12 and extend in particular over the entire length of the indentation. One hard metal plate 12 is in each case arranged in each groove 20. In the exemplary embodiment shown in FIG. 3, the build-up weld 16 is applied only between adjacent hard metal plates 12 and the surface of the indentation 14. No build-up weld 16 is applied within the grooves 20.

The grooves 20 allow precise positioning of the hard metal plates 12 in the indentation 14 of the tool 10, wherein application of the build-up weld 16 to the hard metal plates 12 and the surface of the indentation 14 is further simplified.

Figure 4:
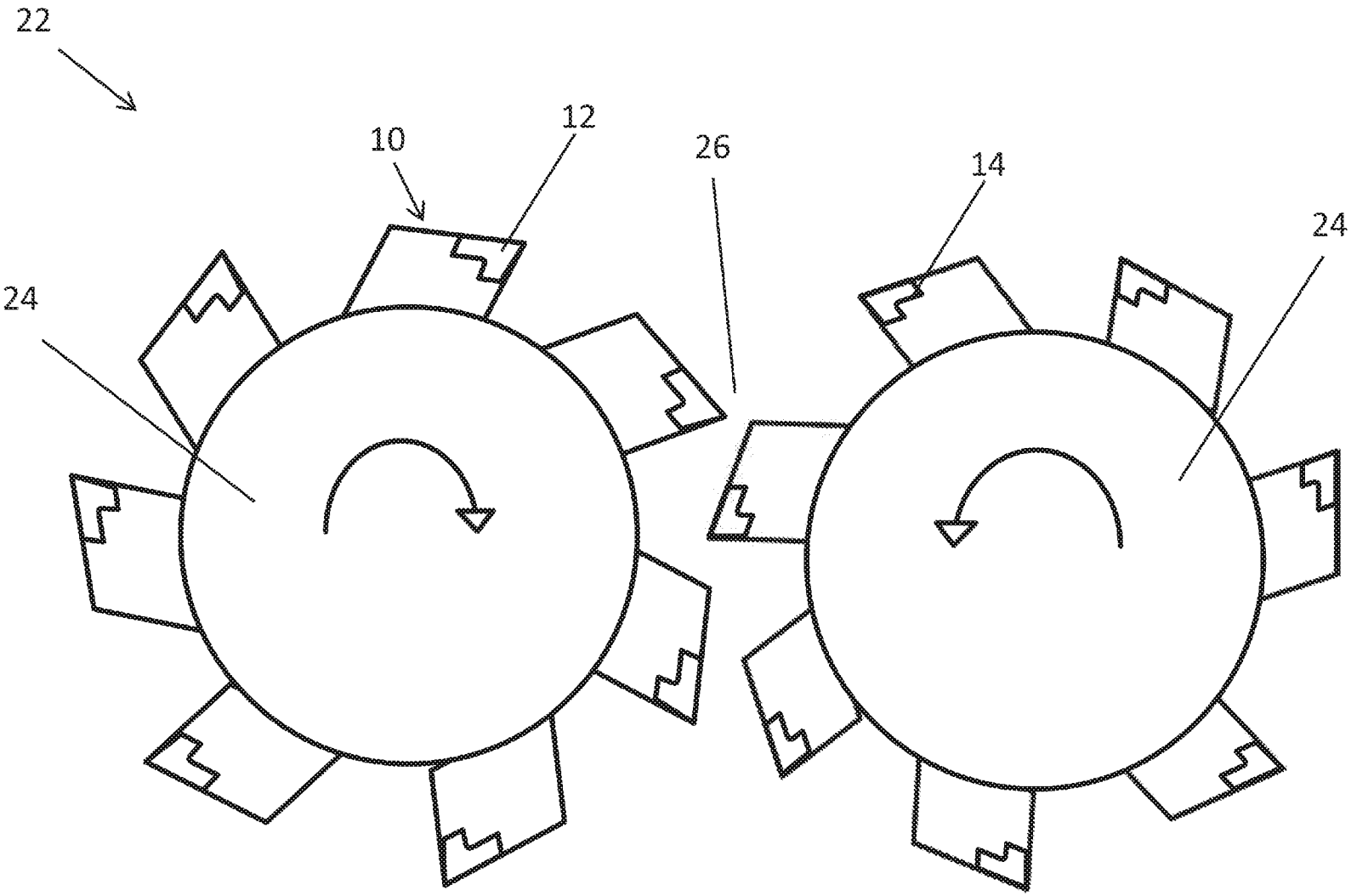
FIG. 4 is a schematic side view of an example crushing apparatus with still another example tool.

FIG. 4 shows a processing apparatus 22, in particular a crushing apparatus with a roll crusher and a tool 10 with a hard metal plate 12 arranged in an indentation 14, in particular a worn region, as described with reference to FIG.

1, 2 or 3. The crushing apparatus 22 comprises two crushing rolls 24, which rotate in opposite directions to one another, in the directions shown by the arrows, wherein the direction of rotation of the crushing rolls 24 is the crushing direction. A plurality of tools 10 are arranged spaced uniformly from one another on the outer circumference of the crushing rolls 24. Between the crushing rolls 24 a crushing gap 26 is formed, into which the material to be crushed is fed. The tools 10 are arranged on the outer circumference of the crushing rolls 24 in such a way that the indentations 14, in particular the worn region, point in the direction of rotation of the crushing rolls 24.

LIST OF REFERENCE SIGNS

10 Tool
12 Hard metal plate
14 Indentation
16 Build-up weld
18 Main tool body
20 Groove
22 Processing apparatus
24 Crushing rolls
26 Crushing gap

What is claimed is:

1. A tool for processing abrasive materials, the tool comprising:
a main tool body;
a hard metal plate disposed on the main tool body; and
a build-up weld, wherein the hard metal plate is attached to the main tool body via the build-up weld, wherein the build-up weld is disposed on a surface of the hard metal plate and on the main tool body.

2. The tool of claim 1 wherein the hard metal plate is disposed on the main tool body so as to extend in a direction in which a force is configured to act on the tool.

3. The tool of claim 1 wherein the hard metal plate is disposed in a groove formed in a surface of the main tool body.

4. The tool of claim 1 wherein the hard metal plate is a first hard metal plate and the build-up weld is a first build-up weld, the tool comprising a second hard metal plate bonded to the main tool body by way of a second build-up weld.

5. The tool of claim 4 wherein the first and second hard metal plates are disposed parallel to one another.

6. The tool of claim 4 wherein the first hard metal plate is adjacent to the second hard metal plate and is bonded to the second hard metal plate by way of one of the build-up welds.

7. The tool of claim 1 wherein the hard metal plate is a first hard metal plate, wherein the tool comprises a second hard metal plate, wherein the main tool body comprises a first groove and a second groove, wherein the first hard metal plate is disposed in the first groove and the second hard metal plate is disposed in the second groove.

8. The tool of claim 1 wherein the main tool body comprises an indentation in which the hard metal plate is disposed.

9. The tool of claim 8 wherein the hard metal plate fills a cross section of the indentation in the main tool body.

10. The tool of claim 1 wherein a thickness of the build-up weld is greater than a thickness of the hard metal plate.

11. The tool of claim 1 wherein the hard metal plate comprises 90-94% tungsten carbide and 6-10% cobalt.

12. A processing apparatus for processing abrasive materials, the processing apparatus comprising a tool that includes
a main tool body;
a hard metal plate disposed on the main tool body; and
a build-up weld, wherein the hard metal plate is attached to the main tool body via the build-up weld, wherein the build-up weld is disposed on a surface of the hard metal plate and on the main tool body.

13. A method for producing or treating a tool for processing abrasive materials, wherein the tool comprises a main tool body, the method comprising:
positioning a first hard metal plate on the main tool body; and
applying a first build-up weld to the first hard metal plate and the main tool body to attach the first hard metal plate to the main tool body.

14. The method of claim 13 comprising positioning a second hard metal plate on the main tool body such that the second hard metal plate is parallel to the first hard metal plate.

15. The method of claim 14 comprising bonding the second hard metal plate to the main tool body and to the first hard metal plate, which is adjacent to the second hard metal plate, by way of a second build-up weld.

16. The method of claim 13 comprising machining a surface of the main tool body before the first hard metal plate is positioned on the main tool body.

17. The method of claim 13 comprising positioning the first hard metal plate on the main tool body such that the first hard metal plate extends in a direction in which a force is configured to act on the tool.

18. The method of claim 13 comprising forming a groove into a surface of the main tool body before positioning the first hard metal plate on the main tool body, wherein the first hard metal plate is positioned in the groove.

19. The method of claim 13 comprising forming first and second grooves that are parallel into a surface of the main tool body before positioning the first hard metal plate on the main tool body, wherein the first hard metal plate is positioned in the first groove and a second hard metal plate is positioned in the second groove.

20. The method of claim 13 wherein the main tool body comprises an indentation, wherein the first hard metal plate is positioned in the indentation.

* * * * *